United States Patent [19]

Scott

[11] 4,227,040

[45] Oct. 7, 1980

[54] SCREW-ON ELECTRICAL CONNECTOR

[75] Inventor: William J. Scott, Sycamore, Ill.

[73] Assignee: Ideal Industries, Inc., Sycamore, Ill.

[21] Appl. No.: 28,056

[22] Filed: Apr. 9, 1979

[51] Int. Cl.[2] ..... H01R 5/12

[52] U.S. Cl. ..... 174/87

[58] Field of Search ..... 174/87

[56] References Cited

U.S. PATENT DOCUMENTS

| | | |
|---|---|---|
| 3,297,816 | 1/1967 | Waddington . |
| 3,448,223 | 6/1969 | Thorsman . |
| 3,519,707 | 7/1970 | Krup . |
| 3,676,574 | 7/1972 | Johansson . |
| 3,875,324 | 4/1975 | Waddington . |

FOREIGN PATENT DOCUMENTS

| | | |
|---|---|---|
| 777950 | 2/1968 | Canada . |

*Primary Examiner*—Roy N. Envall, Jr.

*Attorney, Agent, or Firm*—Kinzer, Plyer, Dorn & McEachran

[57] ABSTRACT

This is concerned with a so-called screw-on electrical connector which contains or is made up of a plastic insulating cap with a coil spring on the inside which is constructed and arranged to be screwed down on the stripped ends of two or more electric wires. More specifically, the connector is constructed to provide a variable and controlled spring rate or compression load on the stripped ends of the largest number of wire combinations and in a less expensive form.

33 Claims, 9 Drawing Figures

SCREW-ON ELECTRICAL CONNECTOR

SUMMARY OF THE INVENTION

This is concerned with an electrical connector of the so-called screw-on type which has a plastic insulating cap containing a wire coil or spring which is adapted to be screwed down on the stripped ends of two or more electric wires.

A primary object of the invention is a connector of the above type which provides a progressive controlled increase in resistance as it is screwed down on the stripped ends of the wires.

Another object is a connector of the above type with a controlled deformation of the spring or coil during application.

Another object is a connector of the above type which provides more turns of the spring or coil in contact with the conductors.

Another object is a connector of the above type which requires or provides lower torque.

Another object is a connector of the above type which has a firm stop.

Another object is a connector of the above type which requires less wire in the coil than certain types of prior connectors.

Another object is a connector of the above type which requires less plastic in the cap than prior types of connector.

Another object is a connector of the above type which uses a combination of wire and plastic as the compression or holding element.

Another object is a connector of the above type which uses plastic characteristics to modify the function or performance of the coil.

Another object is a connector of the above type which makes part of the plastic function as part of the metal.

Another object is a connector of the above type in which the minimum combination of wires won't cause plastic deformation.

Another object is a connector of the above type in which the minimum combination of wires is against solid plastic.

Another object is an expanding spring connector of the screw-on type which expands both the spring and the plastic.

Another object is a connector of the above type in which the taper of the spring matches the taper of the inside of the bore of the cap.

Other objects will appear from time to time in the ensuing specification and drawings.

DESCRIPTION OF THE PREFERRED EMBODIMENTS

Figure 1:
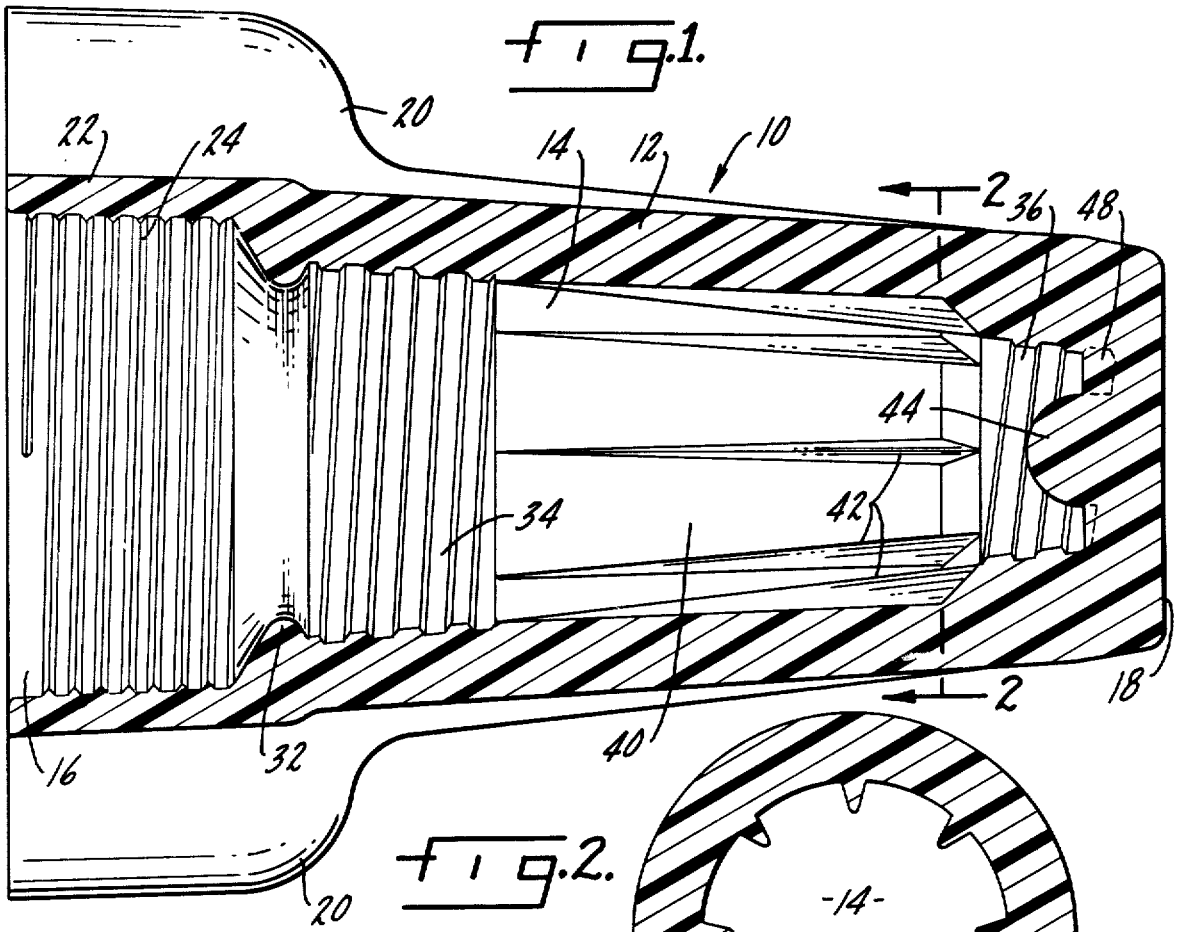
FIG. 1 is a longitudinal section through the shell of such a connector.

In FIG. 1 the connector shell is indicated generally at 10 and has a generally truncated or somewhat conical side wall 12 with a generally open central bore 14, which extends from an open front end 16 at the large end to an integral end wall 18 which closes the small end. The large end may have outstanding levers or ears 20 to provide additional leverage when turning the connector down on the stripped ends of a plurality of wires, if desired. The front or large end of the connector may be considered to be a skirt 22 which may be threaded on the inside, as at 24, if desired, to engage and hold the insulation of the wires and to prevent arcing, which is conventional.

Figure 3:
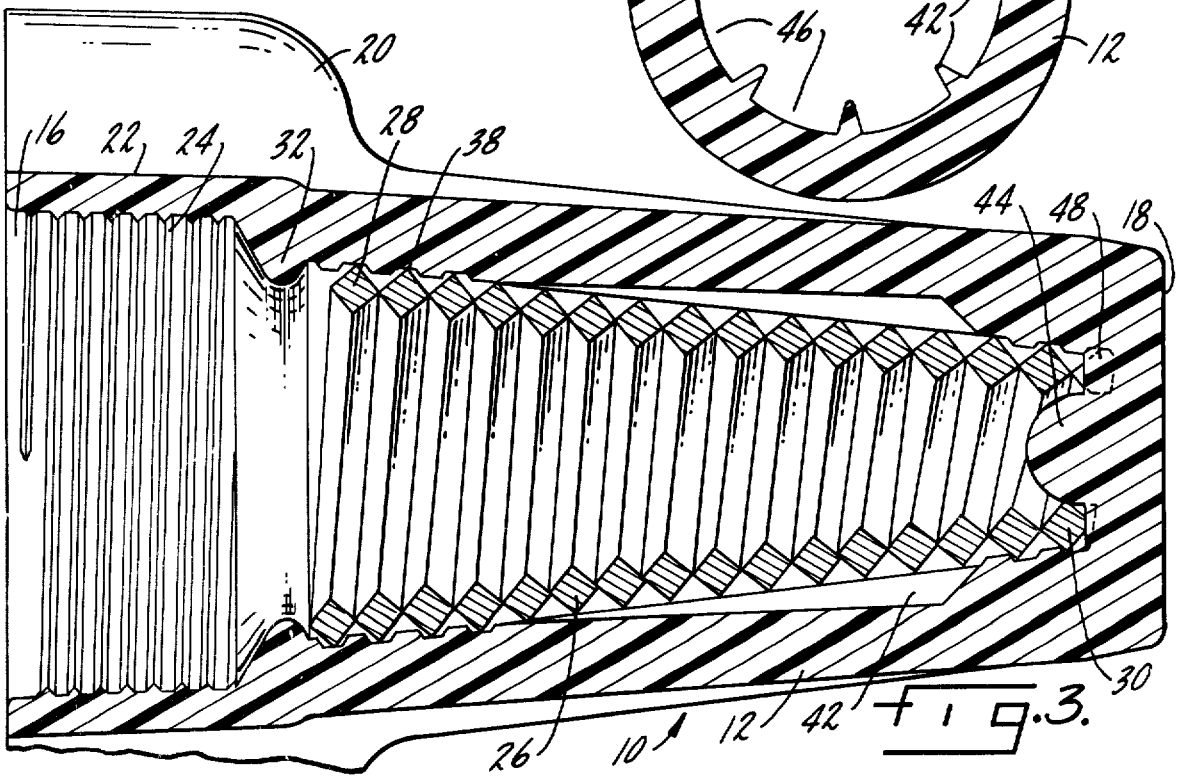
FIG. 3 is a section similar to FIG. 1, but with the spring or coil in place.

In FIG. 3 a coil or spring 26 is shown in the bore of the connector proceeding from a large end 28 to a small end 30 which is in contact with the end wall 18. The spring or coil may be held or retained in the bore of the connector by an upset or dam 32 which may be circumferentially continuous or in segments, as desired.

Figure 2:
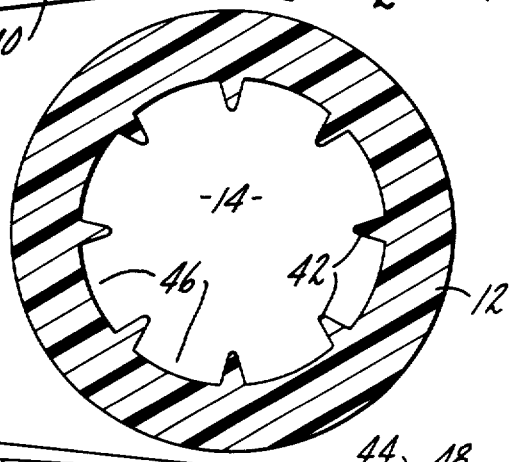
FIG. 2 is a section along line 2—2 of FIG. 1.

The bore of the connector is provided with a first area 34 which in the form shown is provided with relatively low threads with a pitch that about matches the general pitch of the coil. The other or small end of the bore is provided with an area 36 which is threaded in a similar manner. It will be noted that the wire or the coil is square in cross section to provide a series of outstanding ridges or relatively sharp crests 38. There is an intermediate area 40 in the shell which is provided with a plurality of longitudinally disposed extensions 42 which, as shown, extend axially and project a greater distance inwardly toward the closed or small end of the bore so that the crests or crowns thereof provide a continuous, uniform taper, as shown in FIG. 3, which generally matches or corresponds to the taper of the wire crests 38. Also, the extensions 42 narrow or diminish inwardly, as shown in FIG. 2, so that each is broader at its base, where it joins the wall of the housing, than it is at its apex or crest, where it opposes the outside of the coil.

The end wall on the inner surface thereof may be provided with a hemispherical projection 44 which, in addition to centering the inner end of the coil, also serves to prevent one or more of the stripped ends of the wires from drilling through the end wall.

The longitudinally disposed extensions 42 in a sense take on the appearance or function of large portions of the plastic being removed in the intermediate area so that a plurality of longitudinal grooves or open channels 46 are provided between the extensions so that the expansion rate or resistance of the coil to expansion in the intermediate area is modified by whatever portion of the plastic is left. It will be understood that the coil itself is on a generally uniform taper and in the socket area 36, the tip or end or cut terminous portion of the wire itself may engage a stop shoulder 48.

Figure 4:
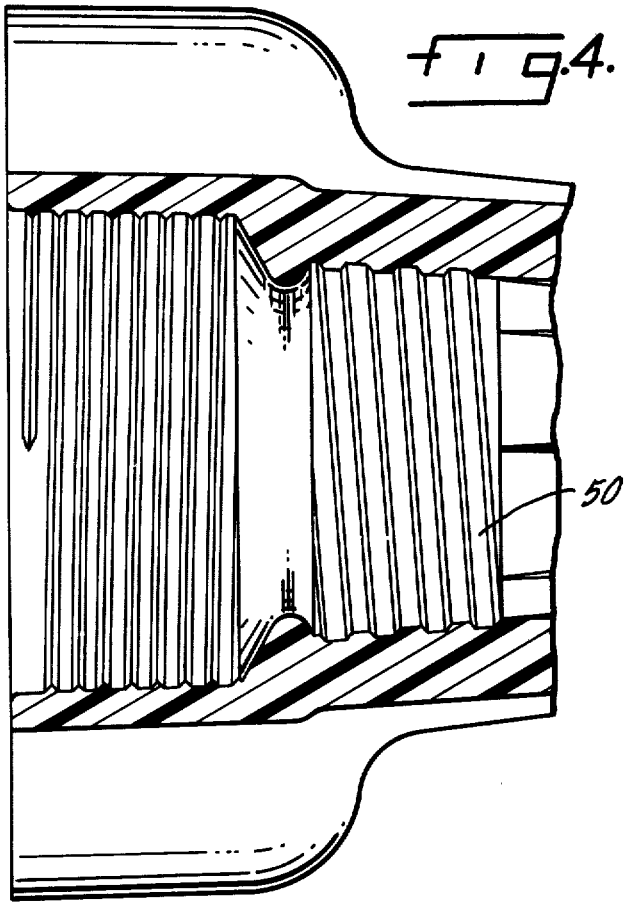
FIG. 4 is similar to FIG. 1 of a modified form.

In FIG. 4 a modified form has been shown in which in the forward or outer area, which was designated 34 in FIG. 1, the threads have been shown at 50 as having or being formed as a left-hand helix, rather than right-hand. Thus, when the coil is inserted or turned into the cap, the turns at the front or large end will cross-thread which serves to more fully or firmly seal or hold the coil in the cap.

Figure 5:
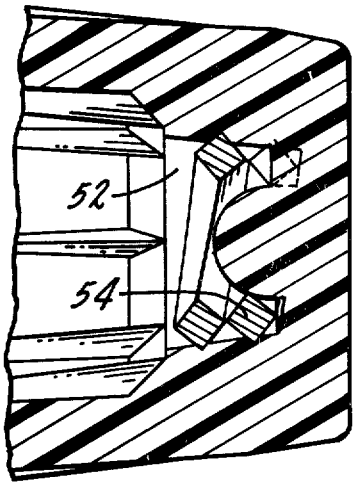
FIG. 5 is a further variation.

In the modified form shown in FIG. 5, the socket or small end 52 of the bore is formed as a square, with four sides which mesh with or are indented by the rear end 54 of the coil. The outside diameter of the coil at the small or inner end 54 will be somewhat greater than the side dimension of the square so that while the coil will clear the corners of the square, it will bite or indent into the sides. Since the inner end 54 of the coil is tapered toward a minimum diameter, only a certain number of the turns of the small end, for example two, will actually indent or engage the flat sides of the socket 52. Across the corners of the square the square is larger in dimension than the outside diameter of the coil at the small end. As before, the terminous or end of the wire itself may engage a stop shoulder which will transmit the torque applied to the cap to the coil to drive it down or force it over the stripped ends of the wires. While the socket 52 has been referred to as being a square, it should be understood that it could have more than four sides, for example six or eight, and therefore should be thought of as a polygon.

Figure 6:
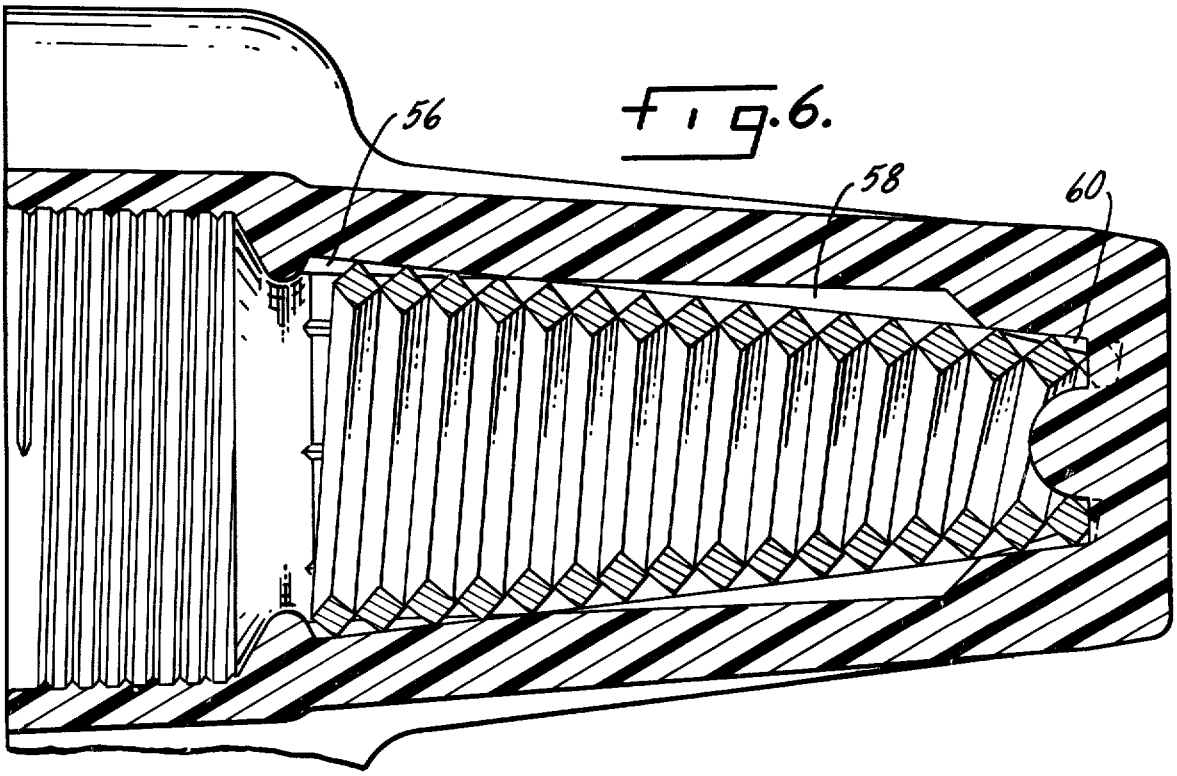
FIG. 6 is a further modification.

In FIG. 6 a further variation has been shown in which the inner bore of the cap again is divided into three general areas, an outer area 56, an intermediate area 58, and an inner area 60. The full length of the inner bore of the cap is provided with longitudinally extending, circumferentially spaced ridges or risers, which may be considered to be fins. Any suitable number may be used peripherally around the inside of the cap and in the form shown in FIG. 6, the fins are aligned from one section to another, but they do not have to be that way. This is to say that more fins might be used in one area than in another. And a single fin would not necessarily continue all the way from one end to the other inside the bore, even if the same number is used.

As shown in the outer area, the fins are circumferentially spaced and are on a certain included angle which may be considered to be a relatively flat or large angle. The coil is at a predetermined cone angle, and the angle of the crests of the fins in the outer area 56 is greater than the cone angle of the coil with the dimensioning being such that a number of the largest turns, for example two or three, of the coil bite into and indent the ridges so as to provide an interlock when the connector is in its free or natural state after assembly.

In the intermediate area 58 the ridges or risers have their crests on roughly the same angle as the crests of the coil so that they generally match each other and may be considered to be in contact. Thus, the angle of the riser crests in the intermediate area 58 is less than the angle in the outer area 56.

At the inner end 60 risers or radial extensions are provided which are at a lesser angle than the cone angle of the coil. And the dimensioning is such that the inner end of the coil will socket into and indent the risers in area 60 in an action similar to what takes place at the outer end 56.

The result will be that the coil will be interlocked both at its outer and inner ends, but in the intermediate area the coil will be relatively free, or at least will not be indenting the risers to any appreciable or significant extent. The action involved will thus be similar to that of FIG. 3 with the interlock at each end being somewhat different. As before, the end of the wire at the small end of the coil in FIG. 6 may abut a stop shoulder. Or the tapering of the coil and riser area 60 may be such that they tightly socket together, a lesser cone into a greater cone, until they come to a stop, without the necessity of a definite right angle shoulder against the end of the wire.

Figure 7:
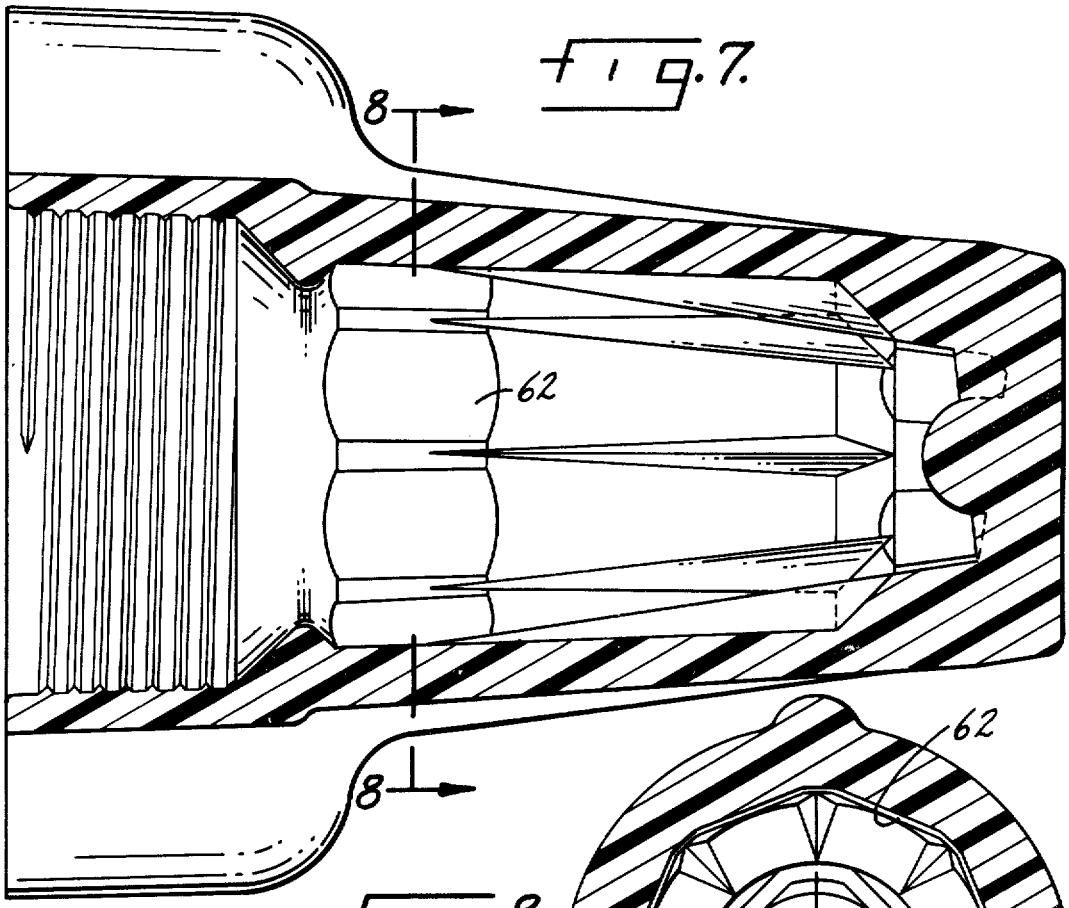
FIG. 7 is a longitudinal section through the shell of a variant form.
Figure 8:
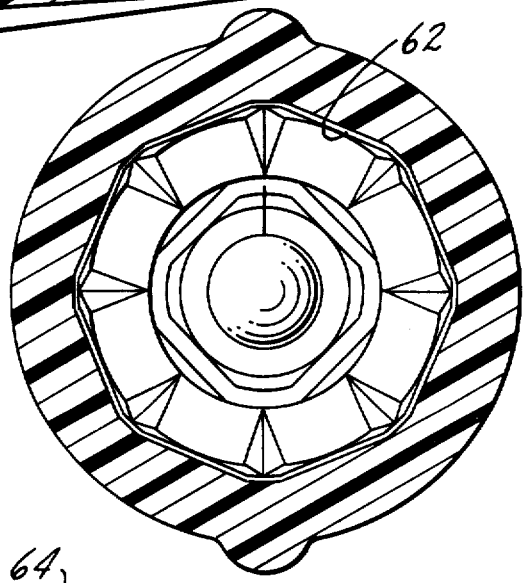
FIG. 8 is a section along line 8—8 of FIG. 7.

In FIG. 7 a further variant is shown in which instead of using threads, either left or right hand, or risers at the outer area in the central bore of the cap, a plurality of flats 62 are provided which, as shown in FIGS. 7 and 8, are eight in number so that an octagon is used, but it might be more or less. This is to say that the outer surface may be considered to be a series of flats of a selected or appropriate number and therefore may be considered to be an octagon. The indenting action of the outside of the coil at the large end into and against the flats or surfaces is similar or may be the same as that previously explained in connection with the socket having flats at the small end.

Figure 9:
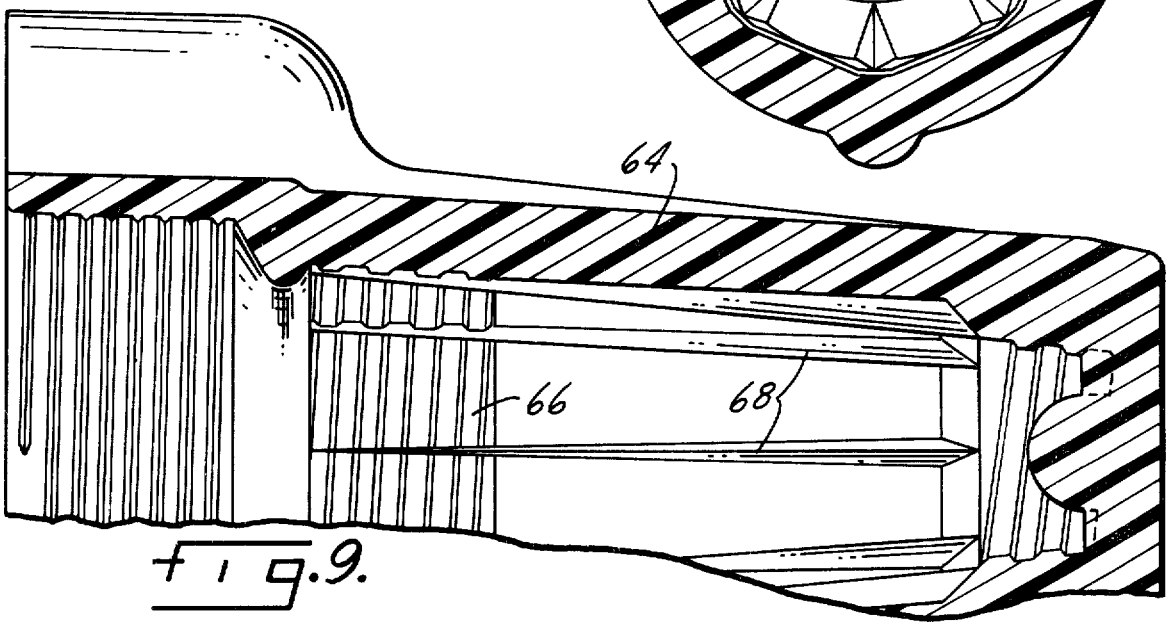
FIG. 9 is a partial view similar to FIG. 1 of a further modification.

As shown in FIG. 9, the outer surface 64 may have a combination of either right or left hand threads 66, which in this case are shown as right hand threads, combined with a plurality of longitudinally extending ridges or risers 68 which may be equally spaced circumferentially around the surface so that the locking action involved at the large end of the coil has a combination of matching or mismatching threads with whatever plastic indentation takes place or is desired and grooving of the risers or ridges by the outside of the coil's large end.

The use, operation and function of the invention are as follows:

The coil or spring is on a generally uniform taper which is matched by the taper of the cap bore. The coil is held at each end by a relatively tight or interlocking fit but in between is liberated somewhat so that a controlled expansion may take place. This is to say that the fit between the big and small ends of the coil and the bore of the cap is such that the coil is relatively bound or confined by a relatively solid or nonexpanding band of plastic which will definitely retard or prevent or minimize outward expansion of the coil. In the intermediate area, however, large portions of the plastic are removed so that a plurality of longitudinal grooves or open channels are provided leaving ridges or isolated elongations in between, which are disposed at suitable intervals so that, as a totality, they will resist the outward expansion of the coil in the intermediate area on a controlled, predetermined basis. As the connector is screwed down on the stripped ends of the wires, the coil in the intermediate area will itself resist outward expansion, but it will not be backed up or surrounded by a solid band of confining or resisting plastic. Rather, the open areas between the ridges 42 will not resist outward expansion of the coils and only the inwardly projecting or remaining ridges will function to retard or influence the outward expansion of the spring. In this sense, the ridges add their characteristics to the expanding spring, with a result that the ridges, which are deformable or distortable, combine with the coil in the intermediate area of the bore to provide a spring or coil effect that is a combination of metal and plastic. Stated another way, the plastic ridges influence or modify the characteristics of the metal coil as it expands so that when viewed together the coil becomes a combination of metal and plastic.

This combined metal-plastic spring has the advantage that, everything else being equal, the spring can be reduced in size, which means less metal is used which reduces cost.

As shown in FIG. 3, the outer crests 38 of the coil appear to be and, in fact, may be considered to be in contact with the crests of the ridges 42 when the connector is in its free or normal state. But precise or exact contact is not essential. There might be some indenting of the plastic at one place or another by the coil in the immediate area when the connector is assembled and prior to use, or there might be a slight spacing indicating no contact. But as a theoretical ideal, contact is desired, but without deformation of the plastic, which is to say that the plastic characteristics are only added to the coil or spring, to any significant extent, when the connector is first applied to the stripped ends of two or more wires.

In a longitudinal direction, the ribs in the intermediate area are tapered so that they are of a minimum height toward the open end of the bore and a maximum toward the closed end. Thus the taper of the ribs can be made to exactly match, on a theoretical basis, the taper of the coil, which has advantages when they are assembled. While the intermediate area of the cap and coil does not provide any interlock or holding force between the two, the coil is firmly held at opposite ends, first in the area shown as threaded in FIGS. 1 and 4 adjacent the big end of the coil, and a similarly threaded area in FIG. 1 and a polygon in FIG. 5 at the small end of the coil. And the degree of interference at either one or both of these areas can be anything desired.

Further, while right hand threads have been shown at the big end in the bore in FIG. 1 to match the turns of the coil, left hand threads might be used, as in FIG. 4, which would cause substantial cross-threading when the coil is first assembled in the cap. In fact, if left hand threads are used, it might be desirable to give them a rather coarse pitch and make them multiple start threads so that between the right hand and left hand intermeshing of the coil and cap threads, a firm interlock would be provided. The same thing might be done at the small end. Or the socket that receives the small end of the coil may be in the form of a square, a hexagon, or otherwise, such as shown and described in my copending application, Ser. No. 936,587, filed Aug. 24, 1978. Also, while a square wire has been shown for the coil, it should be understood that it may be somewhat elliptical, teardrop shape or, for certain applications, round, etc. might be used.

The result it that when the device is used and is screwed down on the stripped ends of the wires, there will be a progressive increase in resistance to the outward expansion of the wires in the middle or intermediate area so that the spring rate or characteristics of the coil are modified in a controlled manner by the remaining plastic which is shown in the form of equally spaced, axially elongated ribs that increase in their radial extent inwardly toward the closed end of the bore.

As compared to a so-called free spring connector, where the spring narrows to a throat so that it is in an hourglass shape, for example, as shown in U.S. Pat. No. 3,075,038, issued Jan. 22, 1963, more turns of the spring will be in contact with the conductors. Further, the torque will be reduced. At the same time, the tight socket effect at the small end of the coil will provide a firm stop and the small end will hold the minimum combination of wires against the solid plastic of the cap that surrounds it. Stated another way, the connector is designed so that the smallest combination of wires are held primarily or only by the coil and plastic at the small end. This is to say that the minimum combination of wires will not cause deformation of the ridges in the intermediate area, although some may occur. But at the same time the largest or most of the combinations will be handled by the central area and will cause partial or substantial or complete deformation of the ridges where a combination of spring and plastic effect is obtained in what has been referred to as a "controlled deformation." So a connector of this type will handle a wide range of combinations. The connector should be designed so that the maximum combination of wires, when fully seated, causes the coil to deform the ridges completely but stop short of loading or contacting the outer wall in the intermediate area, although some could occur without detrimental effect.

A number of different interlocks have been shown, described or suggested, both as to the large end and the small end of the coil. And a suitable combination with variations thereon may be used depending upon the particular application desired. Risers or ridges may be used at either the large or the small end either in combination with right or left hand threads or the threads alone may be used. Any particular combination will have certain advantages and the interlock that is desired or necessary may be acquired by whichever one is used with the ease of molding the cap being an important consideration.

Whereas a preferred form and several variations of the invention have been shown and described, it should be understood that suitable additional modifications, changes, substitutions, and alterations may be made without departing from the invention's fundamental theme.

The embodiments of the invention in which an exclusive property or privilege is claimed are defined as follows:

1. In an electrical connector of the screw-on type for joining the ends of two or more electric wires, a cap of stiffly flexible insulating material having a generally central bore open at one end and enclosed at the other end by an integral end wall, a generally tapered wire coil in the bore, the outer end of the coil being toward the open end of the cap and in engagement with an outer area on the inner surface of the central bore, the inner end of the coil being in engagement with an inner area on the inner surface of the central bore adjacent the end wall, and a central area in the bore between the inner and outer areas engaging the coil in its free state and having less resistance to expansion of the coil than that of the outer area.

2. The structure of claim 1 further characterized in that the wire coil has a generally uniform taper from its outer to its inner end.

3. The structure of claim 1 further characterized in that the outer and inner areas on the inner surface of the central bore are threaded and generally match the turns of the wire coil so as to be in mesh therewith.

4. The structure of claim 1 further characterized in that the central area has a plurality of peripherally spaced, longitudinally extending ribs.

5. The structure of claim 4 in which each of the ribs is axially disposed.

6. The structure of claim 1 further characterized in that the wire of the coil is square in cross section.

7. The structure of claim 1 further characterized in that the central area is constructed and arranged so that the resistance offered to the coil increases as the coil expands when the connector is being screwed down on the stripped end of the electric wires.

8. The structure of claim 1 further characterized in that the outer area on the inner surface of the central bore is provided with a plurality of longitudinally extending, circumferentially spaced fins which are indented by and in an interference fit with the outer end of the coil.

9. The structure of claim 1 further characterized in that the inner area of the inner surface of the central bore is provided with a plurality of longitudinally extending, circumferentially spaced fins which are indented by and in an interference fit with the inner end of the coil.

10. The structure of claim 1 further characterized in that the inner area of the inner surface of the central bore adjacent the end wall has a polygonal cross section, thereby presenting a number of flat side surfaces to the inner end of the coil, at least one turn of the coil at the inner end engaging and indenting the flat side surfaces.

11. The structure of claim 1 further characterized by and including a plurality of longitudinally extending, circumferentially spaced fins meshing with, indented by, and in an interference fit with the coil only at the inner and outer ends thereof.

12. The structure of claim 1 further characterized in that the outer area on the inner surface of the central bore is provided with a plurality of left-hand threads which cross-thread and interlock with the outer end of the coil.

13. The structure of claim 1 further characterized in that the outer area on the inner surface of the central bore has a ploygonal cross section, thereby presenting a number of flat side surfaces to the outer end of the coil, at least one turn of the coil at the outer end engaging and indenting the flat side surfaces.

14. The structure of claim 1 further characterized in that the outer area of the inner surface of the central bore is provided with a plurality of threads and a plurality of longitudinally extending, circumferentially spaced fins superimposed thereon meshing with, indented by, and in an interference fit with at least one turn of the coil at the outer end thereof.

15. The structure of claim 1 further characterized in that the inner and outer areas on the inner surface of the central bore both have a polygonal cross section, thereby presenting a number of flat side surfaces to the inner and outer ends of the coil, at least one turn at each end of the coil engaging and indenting the flat side surfaces.

16. In an article of manufacture, a connector for joining the stripped ends of two or more electric wires, including an insulating cap with a generally central bore open at one end and enclosed by an integral end wall at the other end, the cap being of a stiffly flexible plastic material, a generally tapered wire coil in the bore, the large end of the coil being adjacent the open end of the cap and in an interference fit therewith, the coil being tapered toward the closed end wall of the cap and being otherwise out of contact with the cap bore for a substantial distance toward the closed end wall of the cap, thereby creating what would otherwise be an annular air gap, and an annular formation in the air gap constructed and arranged to resist outward expansion of the coil on a controlled basis and to impart characteristics to the coil that it would not otherwise have if it was allowed to expand freely on its own as the connector is screwed down on the stripped ends of two or more electric wires.

17. In an electrical connector of the screw-on type for joining the stripped ends of two or more electric wires, a cap made of stiffly flexible insulating plastic material having a generally central bore open at one end and closed at the other end by an integral end wall, a generally tapered wire coil in the bore, the outer end of the wire coil being toward the open end of the bore and in engagement with an outer area on the inner surface of the bore, the inner end of the coil being in engagement with an inner area on the inner surface of the bore adjacent the end wall, and an intermediate area in the bore between the inner and outer areas longitudinally in substantially continuous contact with the turns of the coil in their free state in peripherally isolated areas so that outward expansion of the turns of the coil will be yieldably resisted by the intermediate area.

18. The structure of claim 17 further characterized in that the intermittent area includes longitudinally extending, inwardly projecting fins peripherally spaced about the inner bore of the cap with the crest thereof on a taper that generally matches the taper of the coil.

19. The structure of claim 18 further characterized in that the fins increase in radial extent axially inwardly from the open end toward the closed end of the bore.

20. The structure of claim 17 further characterized in that the outer and inner areas on the inner surface of the bore are provided with threaded surfaces to engage the outer and inner ends of the wire coil.

21. The structure of claim 17 further characterized in that the intermittent area includes a plurality of axially disposed, inwardly projecting fins on the inner surface of the bore of the cap.

22. The structure of claim 17 further characterized in that the wire of the coil has a square cross section.

23. The structure of claim 17 further characterized in that the intermediate area is constructed and arranged to progressively increase resistance to the expansion of the wire coil as it is turned down on the stripped ends of the larger combinations of wires.

24. The structure of claim 17 further characterized in that the outer area on the inner surface of the central bore is provided with a plurality of longitudinally extending, circumferentially spaced fins which are indented by and in an interference fit with the outer end of the coil.

25. The structure of claim 17 further characterized in that the inner area of the inner surface of the central bore is provided with a plurality of longitudinally extending, circumferentially spaced fins which are indented by and in an interference fit with the inner end of the coil.

26. The structure of claim 17 further characterized in that the inner area of the inner surface of the central bore adjacent the end wall has a polygonal cross section, thereby presenting a number of flat side surfaces to the inner end of the coil, at least one turn of the coil at the inner end engaging and indenting a plurality of the flat side surfaces.

27. The structure of claim 17 further characterized by and including a plurality of longitudinally extending, circumferentially spaced fins meshing with, indented by, and in an interference fit with the coil only at the inner and outer ends thereof.

28. The structure of claim 17 further characterized in that the outer area on the inner surface of the central bore is provided with a plurality of left-hand threads which cross-thread and interlock with the outer end of the coil.

29. In an electrical connector of the screw-on type for joining the ends of two or more electric wires, a cap of stiffly flexible insulating material having a generally central bore open at one end and enclosed at the other end by an integral end wall, a generally tapered wire coil in the bore, the outer end of the coil being toward the open end of the cap and in engagement with an outer area on the inner surface of the central bore, the inner end of the coil being in engagement with an inner area on the inner surface of the central bore adjacent the end wall, the inner and outer areas on the inner surface of the central bore having a polygonal cross section thereby presenting a number of flat side surfaces, at least one turn at each end of the coil engaging and indenting the flat side surfaces.

30. The structure of claim 29 further characterized in that the wire coil has a generally uniform taper from its outer to its inner end.

31. In an electrical connector of the screw-on type for joining the ends of two or more electric wires, a cap of stiffly flexible insulating material having a generally central bore open at one end and enclosed at the other end by an integral end wall, a generally tapered wire coil having right hand thread in the bore, the outer end of the coil being toward the open end of the cap and in engagement with an outer area on the inner surface of the central bore, the inner end of the coil being in engagement with an inner area on the inner surface of the central bore adjacent the end wall, the outer area on the inner surface of the central bore being provided with a plurality of left-hand threads which cross-thread and interlock with the outer end of the coil.

32. The structure of claim 31 further characterized in that the wire coil has a generally uniform taper from its outer to its inner end.

33. The structure of claim 31 further characterized in that the wire of the coil is square in cross section.

* * * * *